United States Patent [19]

Gropper

[11] 4,287,633

[45] Sep. 8, 1981

[54] CLEANING PAD

[76] Inventor: George Gropper, 45-55 Peason St., Long Island City, N.Y. 11101

[21] Appl. No.: 95,336

[22] Filed: Nov. 19, 1979

[51] Int. Cl.[3] ..... A47L 13/16; A47L 17/04

[52] U.S. Cl. ..... 15/209 B; 15/244 B

[58] Field of Search ..... 15/118, 209 R, 209 B, 15/210 R, 244 B

[56] References Cited

U.S. PATENT DOCUMENTS

| | | | |
|---|---|---|---|
| 2,958,885 | 11/1960 | Donney | 15/244 B X |
| 3,040,353 | 6/1962 | Gray | 15/244 B X |
| 3,252,176 | 5/1966 | Gropper | 15/209 B |
| 3,849,225 | 11/1974 | Haertle | 15/244 B |
| 4,015,306 | 4/1977 | Fenster | 15/209 R |

FOREIGN PATENT DOCUMENTS

| | | | |
|---|---|---|---|
| 1189547 | 3/1959 | France | 15/209 B |

*Primary Examiner*—Edward L. Roberts
*Attorney, Agent, or Firm*—Alexander Mencher

[57] ABSTRACT

A flexible and resilient abrading or detergent pad as a cleansing, scouring and smoothing or finishing device having a pervious and knitted outer covering of synthetic yarn and an engaging core of synthetic plastic sponge frictionally biased against the inner surfaces of the covering walls, the transverse edge areas of the covering and core being compressed and integrated for anchorage of the core to the covering. For manufacture, the sponge core is inserted into the sleeve, the assembly compressed and the transverse edge areas of both covering and core while under compression integrated or connected while under further compression at such areas. Trimming of the reduced and integrated or connected edges takes place following said procedures.

5 Claims, 5 Drawing Figures

FIG. 1
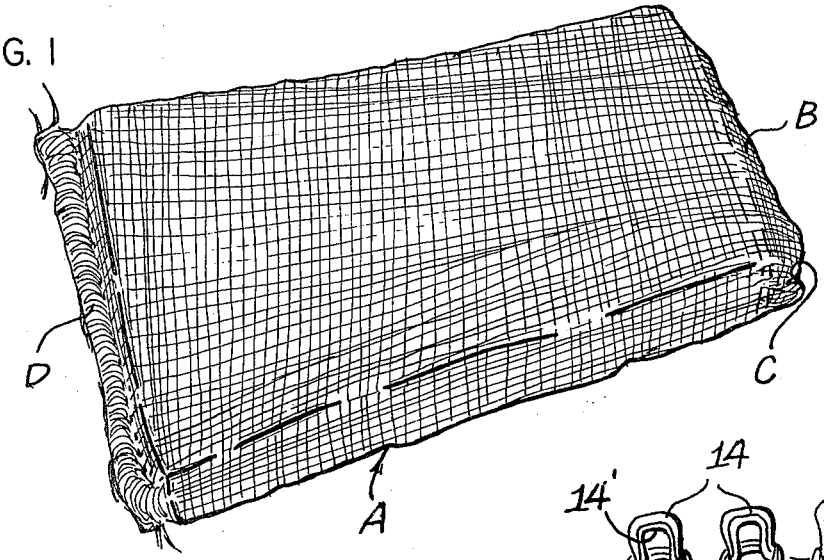
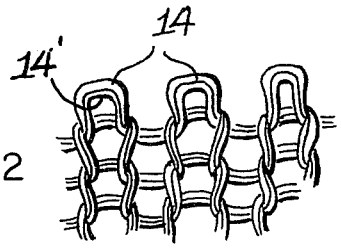
FIG. 2
FIG. 3
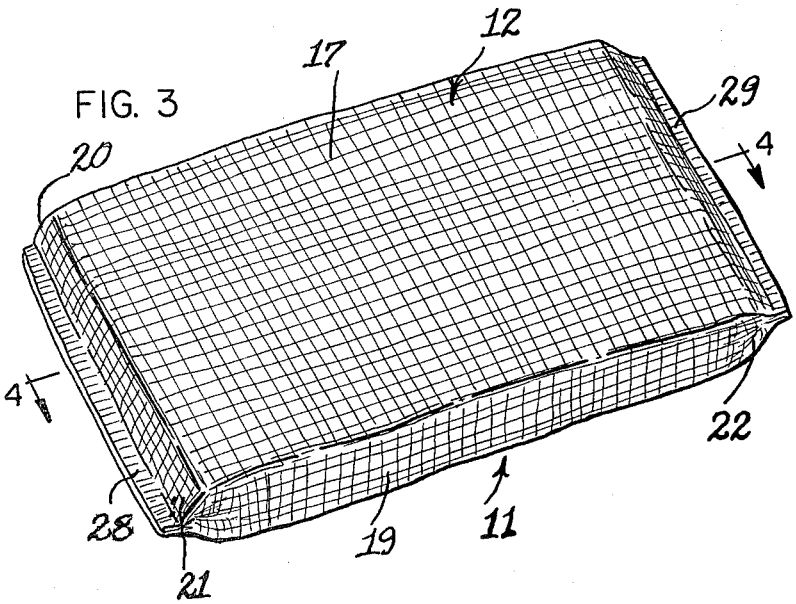
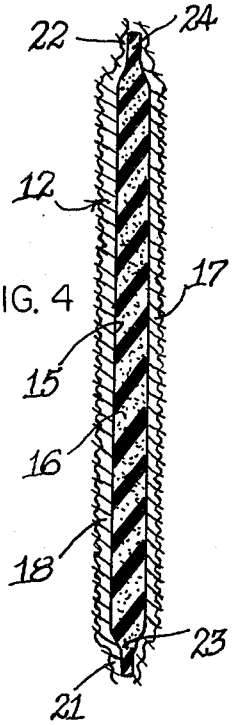
FIG. 4
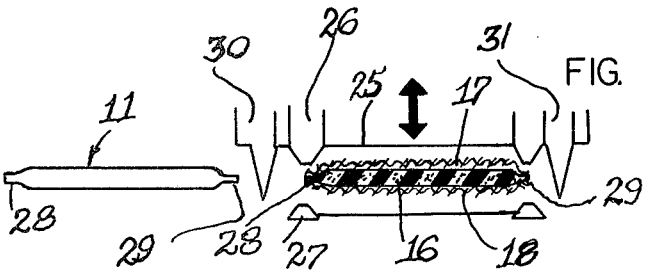
FIG. 5

CLEANING PAD

BACKGROUND OF INVENTION

The invention relates to cleansing, smoothing and finishing devices, but more particularly to a scouring pad or device of the type disclosed in U.S. Pat. No. 3,252,176 under date of May 24, 1966. The type of device shown in the patent is formed of a knitted and pervious abrasive plastic fabric covering as a bag or sack and has an insertion of a plastic sponge core with the open end of the sack stitch-closed, the stitching penetrating one transverse edge of the sponge.

In the usage of such a pad as currently manufactured, the durability and efficiency of the pad are reduced by reason of the lack of close contact between the sponge and the covering, by reason of the opening or unravelling of the edge-stitching, and by reason of the bunching of the sponge away from the perimeter of the covering during use. Such bunching causes excessive and differential wear of the covering, distortion with adverse effects on the sponge, and on the working area of the covering. Moreover, the manufacture of such pads does not lend itself to mass production.

Other prior art known to the applicant and which have been considered lacking in the inventive features of the present invention are:

U.S. Pat. No. 1,663,132 3/1928 Kingman;
U.S. Pat. No. 2,107,636 2/1938 Kingman;
U.S. Pat. No. 2,172,600 9/1939 Van Der Worth;
U.S. Pat. No. 2,601,771 7/1952 Cameron;
U.S. Pat. No. 2,825,914 3/1958 Moss;
French Pat. No. 1,067,233 1/1954;
British Pat. No. 293,898 7/1928;
British Pat. No. 524,452 8/1940;

SUMMARY OF THE INVENTION

Accordingly, a main object of the invention is to provide a scouring and finishing pad having a pervious and knitted outer covering of synthetic yarn or yarns and a plastic sponge core hugging or biased against the inner surfaces of the covering walls, the transverse edge areas of the covering and the core being reduced in thickness and integrated for anchorage of the core to said covering. And a further object of the invention resides in the method of manufacture of such pads.

Other objects of the invention reside in the provision of a scouring pad which is durable, comfortable and safe in the hands of the user in the process of application, non-scratching relative to pots and pans, efficient in use, economic to manufacture, and further adapted for use in the elimination of surface and corner particulates such as for purposes of smoothing wood and other surfaces.

These objects and other incidental ends and advantages of the invention will hereinafter appear in the progress of the disclosure and as pointed out in the appended claims.

BRIEF DESCRIPTION OF THE DRAWING

Accompanying this specification is a drawing showing a preferred form of the invention wherein:

FIG. 1 is prior art and is a perspective view of a scouring pad assembly illustrative of structure as shown in the aforementioned U.S. Pat. No. 3,252,176 and is used herein as a basis of comparison with the present improvements;

FIG. 2 is an enlarged fragmentary plan view showing the knitting stitch adopted in the manufacture of the cover member as used in said U.S. Pat. No. 3,252,176 and also in the present invention;

FIG. 3 is a perspective view of the scouring pad assembly embodying the present invention;

FIG. 4 is a longitudinal sectional view of FIG. 3 across the plane 4—4 thereof; and FIG. 5 is a diagrammatic view illustrating the preferred method of manufacture of the device.

DESCRIPTION OF THE INVENTION

Referring now to FIG. 1 showing an assembly pad over which the instant invention is an improvement, the knitted covering is indicated by letter A and encloses a plastic sponge insert in loose and in disparate engagement areas with the inner surfaces of the covering walls. One of the transverse edges B of the covering of FIG. 1 is closed as by an inturned line of stitching C to form a receiving sack while the mouth of the sack after assemblage is closed by a line of stitching D which may or may not penetrate the transverse edge areas of the sponge.

FIGS. 2–5 are views showing the preferred embodiment which utilizes the fabric covering and the sponge core shown in aforementioned U.S. Pat. No. 3,252,176 but in novel form, disposition, structure and engagement of the elements as heretofore stated and as will appear hereinafter.

Thus, the scouring pad assembly suitably adapted to be saturated with detergents if called for is indicated generally by numeral 11 and includes a flexible cover member 12 consisting of a plurality of rows of knitted stitches 14 of cut, synthetic film in abrasive form such as Mylar, each of which defines an outwardly facing friction edge area especially adapted for dislodging food particles from cooking utensils or for smoothing or sanding purposes as hereinbefore mentioned. The cover or knit 12 as stated is constructed from strands of Mylar which are nonabsorbing, inert to most chemicals, long-lasting and relatively shape-conforming so as to define a friction surface for the purposes described.

Cover member 12 within the interior 15 thereof has a flexible, porous and resilient sponge 16, natural or synthetic, but as shown is of polyurethane and is rectangular in shape. Sponge 16 engages, frictionally hugs or is mutually biased with respect to the cover inner surfaces of top and bottom walls 17 and 18, front and rear walls 19 and 20, and end walls 21 and 22. Such disposition is accomplished by the utilization of assembly compression of the cover 12 and sponge 16, and during such compression suitably reducing the thickness of and integrating the cover end wall areas 21 and 22 and the sponge end wall areas 23 and 24 while all of said areas are under further compression.

Thus, and as in the preferred method of manufacture, sponge 16 is introduced into one of the open ends of cover member 12 when in open sleeve form. The assembly is then subjected to the action of a pressure plate (see FIG. 5) for filling out the sponge within the interior 15 of cover 12, said plate being indicated by numeral 25. During such compression, combined further compression and integration from both the pressure and integration elements 26 and 27 are applied to connect or fuse and reduce the cover and wall areas 21 and 22 and the sponge end wall areas 23 and 24 into thin lateral and flexible strips 28 and 29. Said integration, connection or fusion may be effected ultrasonically, by heat-sealing, adhesive elements or other suitable means to effectuate a strong juncture. Upon release of the assembly after compression and integration of the said end wall areas, sponge core 16 fills out the inner surfaces of the cover walls to effectuate mutual biasing and the said connection or fusion of the corresponding end wall areas of the core 16 and cover 12 anchors such parts together to prevent relative shifting when the pad is in use. As diagrammatically shown in FIG. 5, trimming knives may be used as indicated by numerals 30 and 31 to result in the finished product.

Of course, mass production of the scouring pads described may be effectuated by providing an elongated cover sleeve and an elongated sponge filler intermittently fed to the pressure plate, to the additional pressure-connecting and to the trimming mechanisms.

It is to be recognized that the porous sponge 16 as the main body of the assembly will effectively retain suds and soap for distribution through the porous cover 12 while the exterior friction surface of the latter is used to remove or scour particles of food from cooking utensils. The biased relationship of sponge 16 with respect to cover 12 and the anchorage at ribs or strips 28 and 29 joining the transverse edge areas of the sponge and cover prevent separation or bunching of sponge 16 relative to cover 12 during use, provide body for the friction surface of cover 12, afford fuller area of application to reduce wear on localized areas as a result of bunching, prevent unravelling of the cover, afford shape-retention. Moreover, flexible ribs or strips 28 and 29 afford access of the pad to inaccessible areas.

As hereinbefore stated, the device may be used for purposes other than that of dislodging food particles from cooking utensils. In dry or cleaning-fluid or detergent impregnated form, the cover member 12 having backing from sponge 16 may be used as an abrasive and/or cleaning pad for any and all requirements especially in view of the fact that cover 12 is knitted from inert and durable yarn such as the Mylar mentioned. The yarn is conventionally formed by cutting or slicing the Mylar film in strip form to afford reexposable and abrading edges. Such Mylar yarn and as shown in FIG. 2 may carry an additional yarn element such as fibrous or twisted Nylon to add body, weave appearance and softness to the touch when the pad is in use.

I wish it understood that any minor changes and variations in materials, sizes, integration and shape of parts of the invention as well as minor changes and variations in the method of production involving the invention may all be resorted to without departing from the spirit of the invention and the scope of the appended claims.

I claim:

1. A yieldable, compact, unitary, pervious, shape-retaining and flexible abrading pad comprising: a main compressed and resilient plastic sponge core body, said body being compressed throughout the full area thereof, and a pervious and abrasive plastic cover forming a tight-fitting against the walls of the said compressed and resilient sponge throughout the full respective areas thereof, said compressed and resilient sponge core body and said tight-fitting cover having corresponding transverse edge areas connected and reduced into strip form for anchorage connection to prevent shifting at such areas between said sponge core body and the cover when the pad is in use, the frictional connection between other areas of said sponge core body and said cover also preventing separation thereabout, said cover having top and bottom walls and connecting longitudinal edge areas formed of a continuous knit.

2. An abrading pad as set forth in claim 1 wherein said knit of the cover is formed of a yarn in strip form and cut from Mylar film.

3. An abrading pad as set forth in claim 1 wherein said knit of the cover is formed of a yarn in strip form and cut from Mylar film, said yarn including a fibrous and soft yarn element.

4. An abrading pad as set forth in claim 3 wherein said plastic sponge core body is formed of polyurethane.

5. An abrading pad as set forth in claim 4 wherein said fibrous and soft yarn element is formed of twisted Nylon fiber.

* * * * *